US007594715B2

(12) United States Patent
Osanishi

(10) Patent No.: US 7,594,715 B2
(45) Date of Patent: Sep. 29, 2009

(54) INKJET RECORDING SYSTEM

(75) Inventor: Katsuki Osanishi, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 219 days.

(21) Appl. No.: 11/905,708

(22) Filed: Oct. 3, 2007

(65) Prior Publication Data

US 2008/0084459 A1 Apr. 10, 2008

(30) Foreign Application Priority Data

Oct. 4, 2006 (JP) ..... 2006-272608
Oct. 11, 2006 (JP) ..... 2006-278065

(51) Int. Cl.
*B41J 2/045* (2006.01)
*G01D 11/00* (2006.01)

(52) U.S. Cl. ..... 347/71; 347/100

(58) Field of Classification Search ..... 347/71, 347/68–70, 72, 62–65, 54, 56, 46, 9, 14, 347/15, 100; 400/124.16; 503/226
See application file for complete search history.

(56) References Cited

U.S. PATENT DOCUMENTS

2008/0100675 A1* 5/2008 Furukawa ..... 347/68

FOREIGN PATENT DOCUMENTS

JP 08-127137 5/1996
JP 10-217478 8/1998

* cited by examiner

*Primary Examiner*—K. Feggins
(74) *Attorney, Agent, or Firm*—Clark & Brody

(57) ABSTRACT

An inkjet recording system that discharges pigment ink from a liquid droplet discharge head in which a part of wall surface of pressure chamber is formed of a piezoelectric element, wherein average surface inclination Δa (mrad) of surface of the piezoelectric element forming a part of wall surface of the pressure chamber satisfies $\Delta a \leqq 1050$, and average volumetric particle diameter D (nm) of pigment contained in the ink satisfies $80 \leqq D \leqq 200$. Preferably, the arithmetic average surface inclination Δa and the average volumetric particle diameter D of the pigment satisfy the following formula (1):

$$(1/D)\times\cos^2(\Delta a/1000)>0.003 \quad (1).$$

12 Claims, 8 Drawing Sheets

INKJET RECORDING SYSTEM

BACKGROUND OF THE INVENTION

1. Field of the Invention

The present invention relates to an inkjet recording system realizing improved ink charging ratio (i.e., ratio between discharge nozzle number/total nozzle number) in discharging pigment ink through a liquid droplet discharge head, and providing excellent image quality.

2. Description of Related Art

Conventionally, inkjet recording apparatuses serving as image forming apparatuses such as printer, facsimile machine, copying machine and plotter have been known. A liquid droplet discharge head used in such an inkjet recording apparatus includes a nozzle for discharging a liquid droplet, a liquid chamber (also referred to as discharge chamber, pressure chamber, pressurizing liquid chamber, ink flow channel) communicating with the nozzle, and an actuator that generates energy for pressurizing recording liquid (ink) in the liquid chamber, wherein a liquid droplet is discharged from the nozzle by causing pressure to act on the recording liquid in the liquid chamber by generating energy.

As the liquid droplet discharge head, some apparatuses use a piezoelectric actuator such as electromechanical transduction device, some apparatuses use a thermal actuator utilizing film boiling for electro-thermal transduction device, and other apparatuses use an electrostatic actuator utilizing a vibrating plate and electrostatic force between electrodes.

As the inkjet recording ink, aqueous dye ink in which water-soluble dye is dissolved in aqueous medium has been used because it has high staining power and causes little clogging in a head nozzle.

However, such aqueous dye ink has the problem of insufficient water resistance and weather resistance. From this point, pigment ink having better water resistance, weather resistance compared to dye ink has been increasingly used.

On the other hand, for high-speed printing, a line head system is more suited than a conventional serial head system, however, it is necessary to discharge an ink droplet at a velocity larger than a lower limit value at which sheet conveying velocity has no influence. As a measure that causes ink to be discharged at the velocity larger than that lower limit value, increasing the driving voltage of the actuator can be exemplified. However, with the increase of driving voltage, the load applied onto the actuator increases. This is not desired because the life time of the printer head is shortened, and also from the viewpoint of energy saving.

As a technique concerning maintenance of discharge velocity and recovery of discharge in the line head system, a recording apparatus that has means of controlling ink discharge velocity by controlling either of viscosity of ink, specific gravity, or concentration of solids in the ink is disclosed in Japanese Unexamined Patent Application Publication No. 10-217478. Also a recording apparatus having means of recovering disorder of liquid discharge from a nozzle for each individual head unit is proposed in Japanese Unexamined Patent Application Publication No. 8-127137.

However, when this liquid droplet discharge head is filled with pigment ink using a multi-nozzle liquid droplet discharge head in which a part of wall surface of pressure chamber is formed of a piezoelectric element, non-discharge nozzles occur more frequently compared to the case where dye ink is used, so that troubles such as jet disability, dot missing and disorder of printing occur, leading impairment in printing quality.

As described above, for responding to high-speed printing, it is necessary to discharge ink at a velocity larger than a certain lower limit velocity at which no influence is exerted by sheet conveying velocity. The higher the printing speed, the larger the lower limit velocity should be set. Therefore, in order to make a liquid droplet land at a predetermined position on the recording sheet, the velocity at which the ink droplet lands is preferably 8 m/s or larger, and more preferably 9 m/s or larger. Further, in order to form an image of high quality, it is desired that no non-discharge nozzle occurs, and variation in discharge velocity between nozzles is small.

However, it was demonstrated that when pigment ink was discharged using the above-described multi-nozzle liquid droplet discharge head, the discharge velocity of pigment ink was smaller than that of dye ink, and hence the desired 9 m/s was not realized.

In other words, when an image is formed by using pigment ink, it is impossible to discharge ink at a discharge velocity larger than the lower limit value at which sheet conveying velocity does not influence (9 m/s or larger). Therefore, lines or uneven coloring may significantly occur in association with deviation at the time of landing of ink droplet, so that image quality is impaired.

SUMMARY OF THE INVENTION

It is a primary object of the present invention to provide an inkjet recording system capable of improving the ink charging ratio (that is, ratio of discharge nozzle number/total nozzle number) and reducing jet disability and dot missing, even when pigment ink is charged into a multi-nozzle type head.

It is another object of the present invention to provide an inkjet recording system that reduces lines or uneven coloring due to deviation at the time of landing of ink droplet by reducing variation in discharge velocity of ink droplet discharged from each nozzle of the multi-nozzle type head.

Inventors of the present invention made diligent efforts for solving the above problems, and eventually obtained new findings that ink charging ratio can be improved and jet disability or dot missing can be reduced by using a piezoelectric element having surface of a specific average surface inclination, and using an ink containing a pigment having a specific average volumetric particle diameter.

That is, an inkjet recording system of the present invention discharges pigment inks from a liquid droplet discharge head in which a part of wall surface of a pressure chamber is formed of a piezoelectric element, and arithmetic average surface inclination $\Delta a$ (mrad) of lateral face of pressure chamber of the piezoelectric element satisfies $\Delta a \leqq 1050$, and average volumetric particle diameter D (nm) of pigment contained in the ink satisfies $80 \leqq D \leqq 200$.

Preferably, arithmetic average surface inclination $\Delta a$ (mrad) of lateral surface of pressure chamber of the piezoelectric element, and average volumetric particle diameter D (nm) of the pigment satisfy the following formula (1):

$$(1/D)\times\cos^2(\Delta a/1000)>0.003 \quad (1).$$

According to this inkjet recording system, since the piezoelectric element having surface of specific arithmetic average surface inclination is used, and the pigment ink containing a pigment having a specific average volumetric particle diameter is used, it is possible to improve the ink charging ratio and reduce jet disability and dot missing.

Inventors of the present invention obtained new findings that variation in discharge velocity of ink droplet discharged from the nozzle can be reduced and lines or uneven coloring due to deviation at the time of landing of ink droplet can be reduced by using an ink including a pigment of specific average volumetric particle diameter, and making average surface roughness Ra of piezoelectric element and average volumetric particle diameter D of pigment satisfy a specific relationship.

That is, an inkjet recording system of the present invention has the following configuration.

In an inkjet recording system that discharges a pigment ink from a liquid droplet discharge head in which a part of wall surface of pressure chamber is formed of a piezoelectric element, average volumetric particle diameter D (nm) of pigment contained in the ink satisfies $80 \leqq D \leqq 200$, and the following formula (2) is satisfied:

$$20 < Ra \times (D/2)/(Ra+D/2) < 55 \quad (2)$$

wherein, Ra is arithmetic surface roughness (nm) of surface of the piezoelectric element forming a part of wall surface of the pressure chamber, and D is average volumetric particle diameter (nm).

According to this inkjet recording system, it is possible to stably keep discharge velocity of ink droplet discharged from the nozzle, and to form an image of high quality with little lines or uneven coloring caused by deviation at the time of landing of ink droplet under the influence of sheet conveying velocity, because an ink containing a pigment having a specific average volumetric particle diameter is used, and the relation formula between average surface roughness Ra of piezoelectric element and average volumetric particle diameter D of pigment falls within a specific range.

DETAILED DESCRIPTION OF THE PREFERRED EMBODIMENTS

First Embodiment

Figure 1:
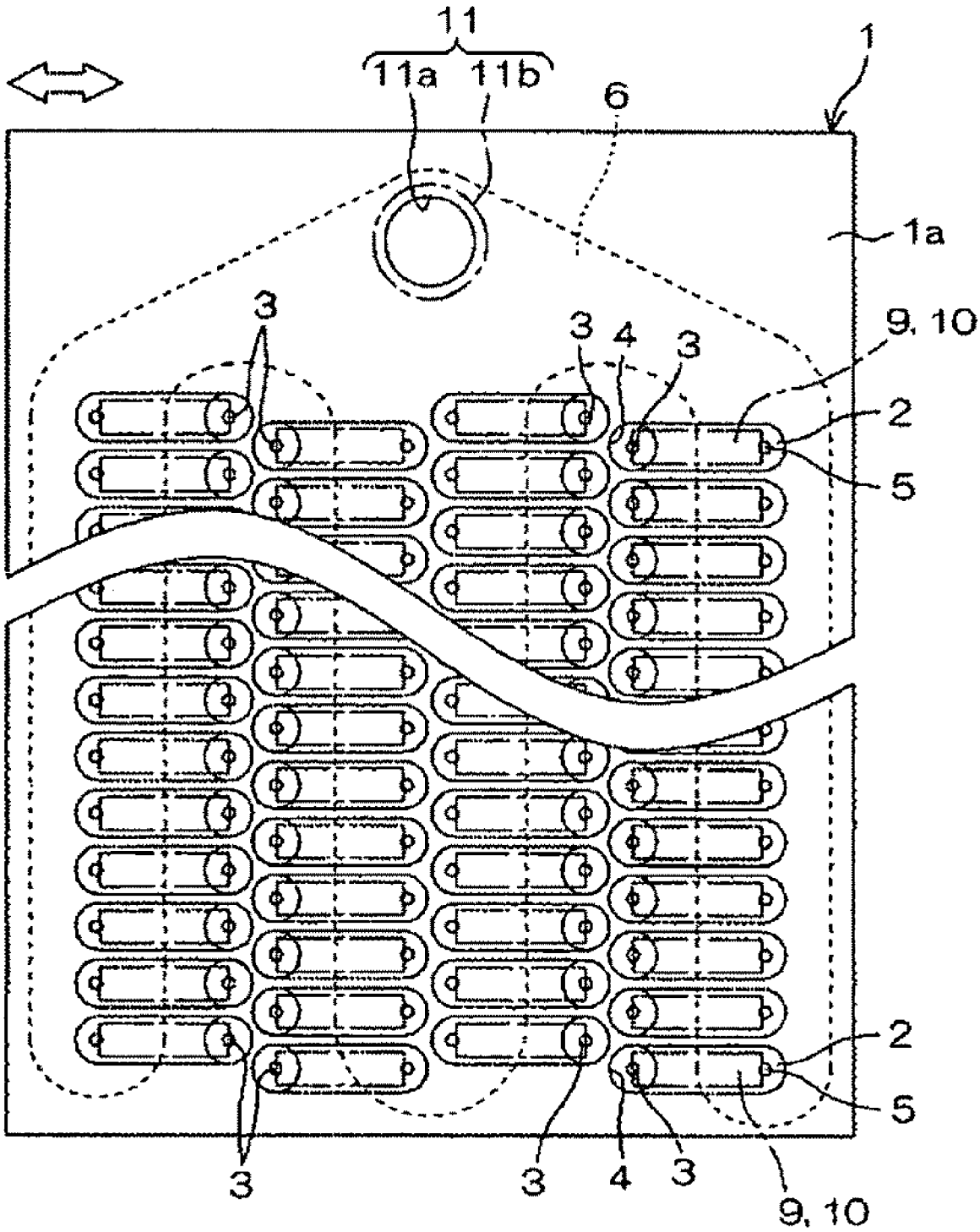
FIG. 1 is a plan view showing a piezoelectric inkjet recording head according to one embodiment of the present invention.

According to an inkjet recording system of the present embodiment, in a liquid droplet discharge head in which a part of wall surface of pressure chamber is formed of a piezoelectric element, arithmetic average surface inclination $\Delta a$ (mrad) of lateral face of pressure chamber of the piezoelectric element satisfies $\Delta a \leqq 1050$, and average volumetric particle diameter D(nm) of pigment contained in ink satisfies $80 \leqq D \leqq 200$. Preferably, arithmetic average surface inclination $\Delta a$ of lateral face of pressure chamber of the piezoelectric element and average volumetric particle diameter D of the pigment satisfy the above formula (1).

The present invention is based on the new findings: (a) when ink containing pigments having different average volumetric particle diameters are charged into a multi-nozzle liquid droplet discharge head incorporating a piezoelectric element having a specific average surface inclination, ink charging ratio differs depending on the difference in average volumetric particle diameter of the pigments, and (b) when ink containing a pigment having a specific average volumetric particle diameter is discharged from a head nozzle of the same type which incorporates a piezoelectric element of different average surface inclination, ink charging ratio differs depending on the difference in average surface inclination.

In brief, in the present invention, when volumetric average particle diameter of the pigment and the average surface inclination of the piezoelectric element fall within the ranges of the present invention, excellent charging ratio of ink is realized, and occurrence of non-discharge nozzle can be reduced. It is to be noted that a lower limit value of average surface inclination of the piezoelectric element is usually about 100 mrad. In contrast to this, when average surface inclination is out of the range of the present invention, charging ratio of ink decreases, and the presence of non-discharge nozzles as a result of this will result in defective image such as dot missing. Further, when the average volumetric particle diameter of pigment is larger than range of the present invention, the charging ratio of ink decreases, and the gravity will act more greatly than Brownian motion, so that deterioration of storage stability such as sedimentation of particles may occur. Further, when the particle diameter is smaller than the range of the present invention, the cover-up characteristic on the recording sheet decreases, and sufficient image concentration may not be obtained.

It was also evidenced that the cause of occurrence of non-discharge nozzle at the time of charging ink has correlation with particle diameter of pigment contained in ink, and average surface inclination of piezoelectric element. To be more specific, we closely examined the relationship between average surface inclination of piezoelectric element and charging ratio, and the relationship between particle diameter of pigment and charging ratio for a piezoelectric element having a specific average surface inclination, and revealed that an inkjet recording system realizing high charging ratio and stability can be achieved by satisfying the above formula (1).

Figure 8:
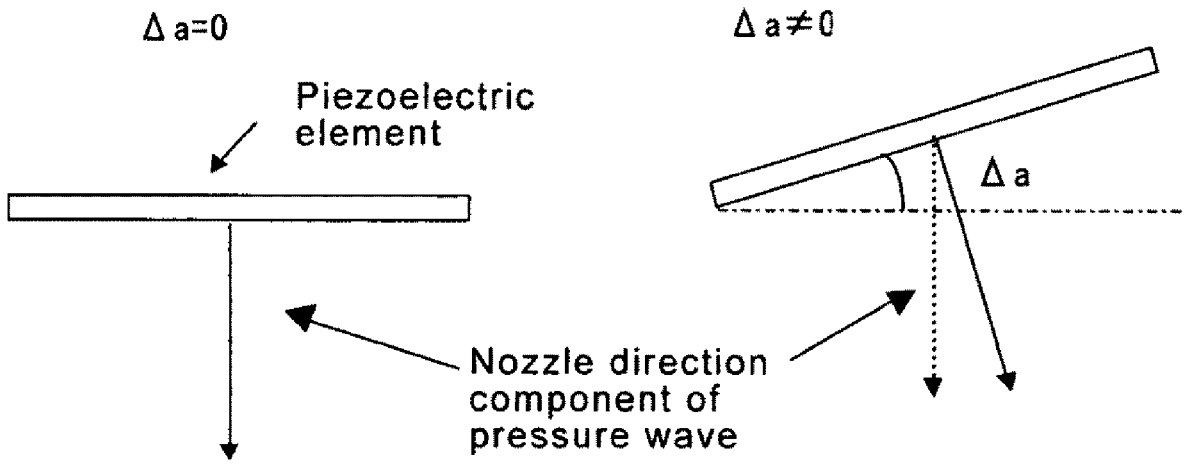
FIG. 8 is a schematic view showing the relationship between average surface inclination $\Delta a$ and nozzle directional component of pressure wave.

Assuming that average surface inclination $\Delta a$ of surface is related with a phase from a normal vector of piezoelectric element surface when an inclination angel is 0 rad, the decrease in charging ratio in association with increase in average surface inclination Δa is ascribable to the fact that nozzle directional component of pressure wave decreases with increase in surface inclination. As shown in FIG. 8, cosine of Δa which is a nozzle directional component of pressure wavelength, cos(Δa) coincides with the normal vector direction of piezoelectric element surface idealized at the inclination angle of 0 rad. The above formula (1) is referable to a test formula regarding average surface inclination Δa of surface of piezoelectric element and charging ratio of ink.

(Pigment Ink)

The pigment ink according to the present invention is prepared, for example, by dispersing pigments into an aqueous medium. As the pigment, known organic pigments or inorganic pigments used in aqueous paint or aqueous ink may be used without any particular limitation. Examples of the organic pigments include anthraquinone pigments, perylene pigments, disazo pigments, phthalocyanine pigments, isoindolinone pigments, dioxazine pigments, quinacridone pigments, perinone pigments, triphenylmethane pigments, thioindigo pigments, diketo-pyrrolo-pyrrole pigments and benzimidazolone pigments. More specifically, for example, insoluble azo-based disazo yellow AAOT (yellow, C.I. 21095, specific gravity 1.3, DBP oil absorption 50 mL/100 g), insoluble azo-based pirazolone red (red, C.I. 21120, specific gravity 1.3, DBP oil absorption 55 mL/100 g), soluble azo-based brilliant carmine 6B (red, C.I. 15850:1, specific gravity 1.5, DBP oil absorption 65 mL/100 g), copper phthalocyanine-based cyanine blue 15 (blue, C.I. 74160, specific gravity 1.6, DBP oil absorption 40 mL/100 g), copper phtalocyanine-based cyanine green 7 (green, C.I. 74260, specific gravity 2.1, DBP oil absorption 45 mL/100 g), perylene-perynone-based perylene red (red, C.I. 71127, specific gravity 1.6, DBP oil absorption 50 mL/100 g), and oxazine-based dioxazine violet (violet, C.I. 51319, specific gravity 1.4, DBP oil absorption 50 mL/100 g) can be exemplified. Examples of the inorganic pigments include furnace black, lampblack, acetylene black, channel black, carbon blacks such as oxidized carbon black. The aqueous medium used for the inkjet ink of the present invention is water or mixture of water and aqueous organic solvent.

Examples of the aqueous organic solvent include alcohols such as methanol, ethanol and propanol, low-boiling-point solvents such as acetone, dioxane, tetrahydrofuran, 2-butanone and ethyl acetate, polyols such as ethylene glycol, propylene glycol, diethylene glycol, triethylene glycol, polyethylene glycol, polypropyrene glycol and glycerin, and ethers, esters of the same, and high-boiling point solvents such as dimethylacetamide, dimethylformamide, dimethylsulfoxide and dimethylimidazolydinone.

Preferably, the pigment is contained in the amount of 1 to 10 wt. %, preferably 2 to 8 wt. % relative to the total amount of pigment ink. A dye or other additive may be added as necessary to the pigment ink.

(Piezoelectric Inkjet Recording Head)

FIG. 1 is a view of a piezoelectric inkjet recording head (liquid droplet discharge head) used in the present invention, and is a plan view before attaching a laminated piezoelectric element and a piezoelectric actuator containing an individual electrode. On a substrate 1, a plurality of dot formation parts each containing a pressure chamber (liquid chamber) 2 and a nozzle 3 communicating with the pressure chamber 2 are arranged.

Figure 2A:
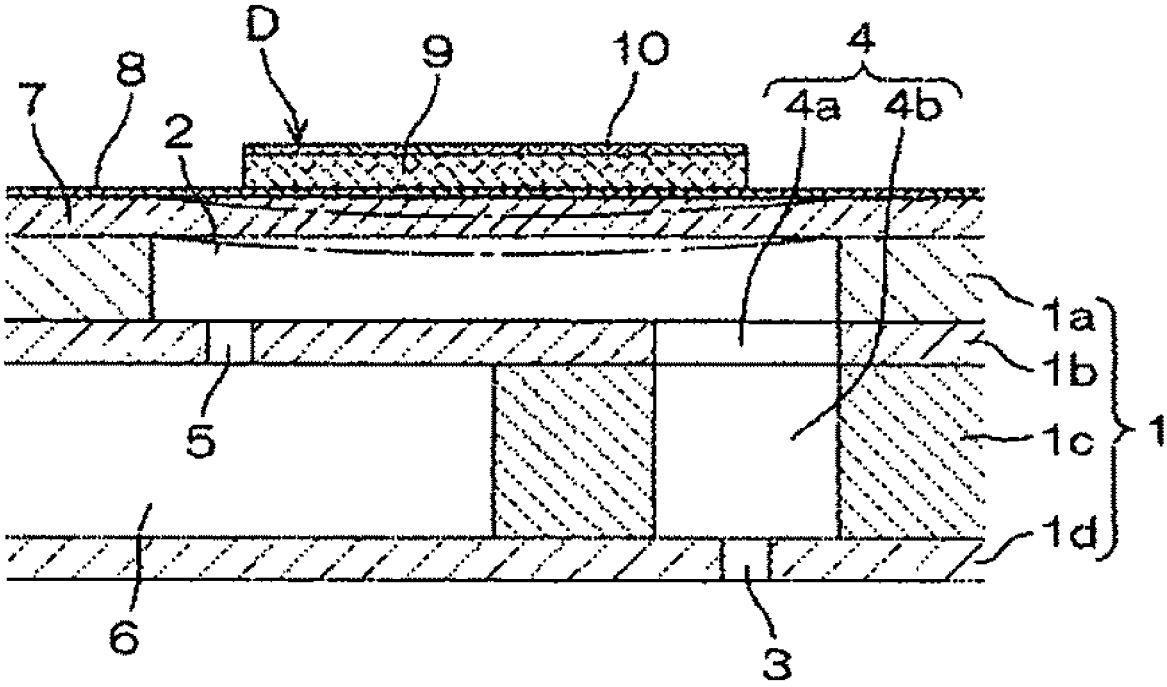
FIG. 2A is a partially enlarged lateral section view of the piezoelectric inkjet recording head shown in FIG. 1.
Figure 2B:
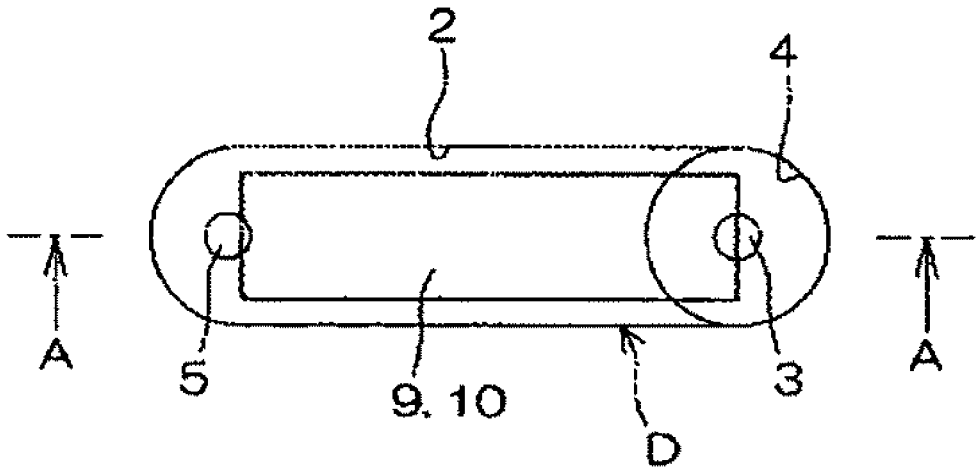
FIG. 2B is a bottom view of the same.
Figure 3:
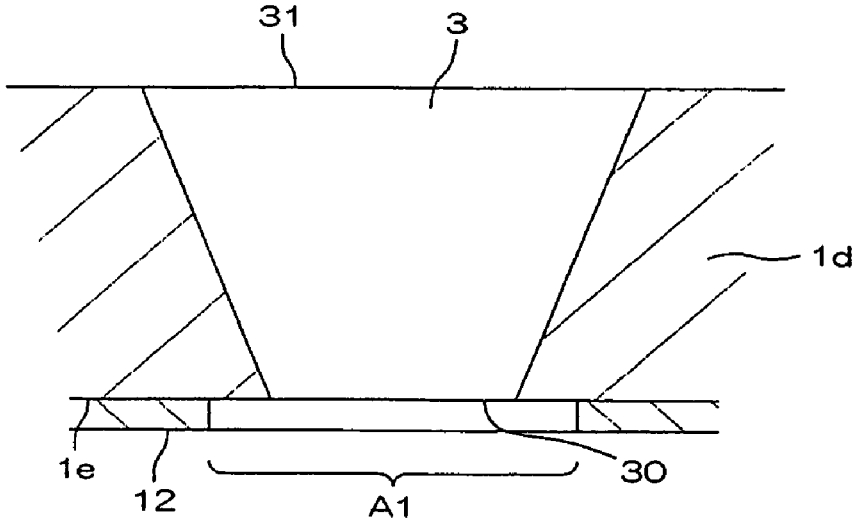
FIG. 3 is a partially enlarged view of FIG. 2A.

FIG. 2A is an enlarged section view showing a dot formation part of one dot in the piezoelectric inkjet recording head to which a piezoelectric actuator is attached, and FIG. 2B is a perspective view showing the stacked state of each part constituting the formation part of one dot. FIG. 3 is an enlarged view of the nozzle 3 and its vicinity in FIG. 2A.

The nozzles 3 of dot formation parts are arranged in plural lines in the main scanning direction shown by the arrow in FIG. 1, and the pitch between dot formation parts in the same line is, for example, 150 dpi. In FIG. 1, the arrangement includes four lines, so that 600 dpi is realized by the entire piezoelectric inkjet recording head. Each dot formation part is so configured that, the pressure chamber 2 of planner shape to which a semicircular end is connected to each end of a rectangular center part formed on the top face of the substrate 1 in FIG. 2A, and the nozzle 3 formed in the position overlapping with the center of the semicircle of either end of the pressure chamber 2 on the bottom face side of the substrate 1 are connected by an ink flow channel 4 having the same diameter with the semicircle of the end and having a circular cross section, while the pressure chamber 2 is connected to a common flow channel 6 (shown by broken lines in FIG. 1) which is formed to connect each dot formation part in the substrate 1 via a supply port 5 formed in the position overlapping with the center of the semicircle in the other end of the pressure chamber 2.

Each part as described above is formed by laminating a first substrate 1*a* forming the pressure chamber 2, a second substrate 1*b* forming an upper part 4*a* of the ink flow channel 4 and the ink supply port 5, a third substrate 1*c* forming a lower part 4*b* of the ink flow channel 4 and the common flow channel 6, and a fourth substrate 1*d* forming the nozzle 3 and becoming a nozzle plate in this order.

As shown in FIG. 3, an opening 30 at the distal end of the ink droplet discharge side of the nozzle 3 is formed into a circular shape on a bottom surface 1*e* of the fourth substrate 1*d* which is the bottom face side of the substrate 1. Also in the nozzle 3, the opening 30 on its distal end side is tapered so that it is smaller than an opening 31 on the side of the pressure chamber 2.

As shown in FIG. 1, the first substrate 1*a* and the second substrate 1*b* are formed with a through-hole 11*a* for constituting a joint part 11 for connecting the common flow channel 6 formed in the third substrate 1*c* to the piping from an ink cartridge (not shown) on the top face side of the substrate 1. Further, each substrate 1*a* to 1*d* is made of, for example, resin or metal, and is formed into a plate member which is to become each part as described above, having a specific thickness and formed with a through-hole by etching utilizing photolithography.

On the top face side of the substrate 1, a piezoelectric actuator AC is formed by laminating a laminate piezoelectric element 8 of thick plate shape having planner shape and operating in lateral vibration mode, which is substantially in the same size with the substrate 1 and has a common electrode 7 therein, and an individual electrode 9 having substantially rectangular same planner shape, provided individually in the position overlapping a center part of the pressure chamber 2 in each dot formation part as shown by dashed-dotted lines in FIG. 1.

Both the common electrode 7 and the individual electrode 9 are formed from metal foil having excellent electric conductivity such as gold, silver, platinum, copper or aluminum, or from a plating film or vapor-deposited film made of such metal. As the piezoelectric material forming the piezoelectric element 8, for example, lead zirconate titanate (PZT), PZT to which one or two or more kinds of oxides such as lanthanum, barium, niobium, zinc, nickel, manganese is added, for example, PZT-based piezoelectric materials such as PLZT can be exemplified. Also those based on lead magnesium niobate (PMN), lead nickel niobate (PNN), lead zinc niobate, lead manganese niobate, lead antimony stannate, lead titanate, barium titanate and the like can be exemplified.

The piezoelectric element 8 may be formed, for example, by adhesively securing a chip having a specific planner shape obtained by polishing a sintered body formed by sitering of the piezoelectric material into a thin plate, in a predetermined position, or by printing a specific planner shape with a paste prepared from powder of metal oxide and organic binder which are materials for piezoelectric material by a sol-gel method (or MOD method), followed by drying, pre burning and burning steps, or by forming a thin film of piezoelectric material into a planner shape by gas-phase growing methods such as reactive sputtering, reactive vacuum deposition, or reactive ion plating.

In order to drive the piezoelectric element 8, for example, in a lateral vibration mode, polarization of the piezoelectric material is made to be oriented in the direction of thickness of the piezoelectric element 8, more specifically, in the direction directing from the individual electrode 9 to the common electrode 7. To achieve this, conventionally known polarizing method such as high-temperature polarizing method, room temperature polarizing method, alternating electric field superimposing method, and electric field cooling method may be used. Further, the piezoelectric element 8 after polarization may be subjected to aging process. The piezoelectric element 8 in which polarizing direction of the piezoelectric material is oriented to the above direction will shrink in the plane crossing at right angles with the polarization direction upon application of a positive driving voltage from the individual electrode 9 while the common electrode 7 is grounded. Therefore, the force when deflection occurs is transferred to the ink in the pressure chamber 2 as a pressure wave, and this pressure wave causes oscillation of ink in the supply port 5, the pressure chamber 2, the nozzle flow channel 4, and the nozzle 3. Then the velocity of the oscillation eventually goes outside the nozzle 3, so that the ink meniscus in the nozzle 3 is pushed externally through the distal end opening 30 of the ink droplet discharge side, and an ink column is formed. Thereafter, velocity of oscillation goes inside the nozzle, while the ink column continues moving in the external direction of the nozzle, with the result that one or two droplets of ink separated from the ink meniscus flies in the direction of sheet face, and forms a dot on the sheet. The amount of ink consumed by flying of ink droplets is recharged into the nozzle 3 by surface tension of the ink meniscus in the nozzle 3, from the ink cartridge, via the piping of the ink cartridge, joint part 11, common flow channel 6, supply port 5, pressure chamber 2, and ink flow channel 4.

On a surface 1*e* of the fourth substrate 1*d* which is the bottom face side of the substrate 1, a planar area A1 which is not subjected to water-repellent finish, and the circular opening 30 of the distal end of the nozzle 3 are provided in overlapping manner. That is, a water repellent layer 12 is overlaid on the surface 1*e* excluding the area A1 to provide water-repellent finish, while in the area A1, water-repellent finish is not made because no water repellent layer 12 is formed and the surface of the fourth substrate 1*d* is exposed. Film thickness of the water repellent layer 12 is preferably, but is not limited to, 0.5 to 2 μm. When the film thickness of the water repellent layer 12 is less than 0.5 μm, water repellency is reduced, and defect in discharge of ink droplet may occur due to adhesion of ink. Even when the water repellent layer 12 having a film thickness of larger than 2 μm is formed, no significant improvement in water repellent effect is observed.

As a driving means of piezoelectric inkjet head used in the present invention, any of (1) and (2) may be used: (1) pull-push system in which the piezoelectric element 8 is caused to deform in the direction in which the volume of the pressure chamber 2 increases, to draw-in the ink meniscus in the nozzle 3, and then the piezoelectric element 8 is caused to deform in the direction in which the volume of the pressure chamber 2 decreases to make an ink droplet separate from the ink meniscus, and (2) push-push system in which the piezoelectric element 8 is caused to deform in the direction in which the volume of pressure chamber 2 decreases, to push out the ink meniscus in the nozzle 3, and then the piezoelectric element 8 is caused to deform in the direction in which the volume of pressure chamber 2 increases to draw in the ink meniscus, thereby making an ink droplet separate from the ink meniscus and discharging the same.

(Method of Manufacturing Piezoelectric Element)

First, to piezoelectric ceramics material containing lead zirconate titanate of 99% or higher purity, piezoelectric ceramics powder containing lead titanate, or piezoelectric ceramics powder containing barium titanate serving as a base material, butyl methacrylate serving as an aqueous binder, ammonium polycarboxylate salt serving as a dispersing agent, and isopropyl alcohol and pure water serving as solvents are respectively added and mixed, and the resultant slurry is formed into a sheet of 30 μm thick on a carrier film by a doctor blade method, to form a green sheet.

Figure 4:
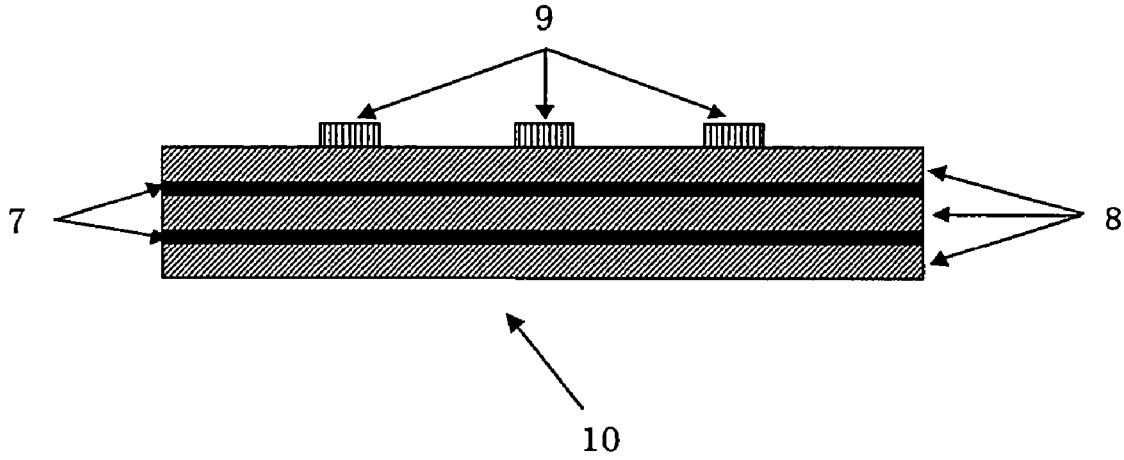
FIG. 4 is a lateral section view of a laminated piezoelectric element according to one embodiment of the present invention.

Next, a conductive paste for internal electrode that contains silver palladium alloy having average particle diameter of 0.3 to 5 μm and containing 80% by volume or more silver is prepared, and the conductive paste is added with a common material having the same composition as the aforementioned piezoelectric ceramics powder. These silver palladium alloy and common material are separately mixed by vehicles containing organic binder and organic solvent, and then these are kneaded thoroughly, to produce a conductive paste. The resultant conductive paste is printed on surface of a green sheet to form an internal electrode layer (common electrode) 7. Further, the face on which the internal electrode layer 7 is printed is made upward, and the green sheet in which the internal electrode paste is not be printed is stacked thereon, to prepare a laminate formed body. The laminate formed body is subjected to pressurizing press, followed by degreasing, and then sintered by retention at 900 to 1000° C. for 4 hours in atmosphere containing 99% or more oxygen. Then on one face of the sintered body, a plurality of surface electrodes (individual electrodes) 9 are formed. The surface electrodes 9 are formed by applying Au paste in screen printing. They are formed by sintering in atmosphere at 600 to 800° C., and a lead line is connected with solder to the surface electrode 9, to finally obtain a laminate piezoelectric element 10 having the shape as shown in FIG. 4.

As a measure for adjusting the arithmetic average surface inclination in surface of the piezoelectric element 10 to $\Delta a \leqq 1050$, mechanically polishing or etching the surface of the piezoelectric element 10 which is to become a part of wall surface of the pressure chamber may be exemplified, but is not limited.

As for the image forming apparatus of the present invention, it is desirable in order to attain a high-speed printing that the inkjet recording head has 500 or more numbers of nozzles, and a width of 1 inch or more. Furthermore, two or more, preferably 2-8, more preferably 2-4 of the inkjet recording heads may be disposed in the horizontal direction which intersects perpendicularly in the conveyance direction of the recording medium. Moreover, it is desirable to use as a line head printer by arranging a plurality of the inkjet recording heads so as to cover a length more than the width of the recording medium. The conveyance speed of the recording medium has preferably 60-100 mm/s.

Second Embodiment

According to an inkjet recording system according to this embodiment, in a liquid droplet discharge head in which a part of wall surface of pressure chamber is formed of a piezoelectric element, average volumetric particle diameter D(nm) of pigment contained in ink satisfies $80 \leqq D \leqq 200$, and arithmetic surface roughness (Ra) of the piezoelectric element surface constituting a part of wall surface of the pressure chamber, and average volumetric particle diameter (D) satisfy the above formula (2).

The present invention is based on the new findings: (a) when ink containing pigments having different average volumetric particle diameters is discharged by using a multi-nozzle type liquid droplet discharge head incorporating a piezoelectric element of a specific surface roughness, discharge velocity of ink droplet differs, and (b) when ink containing a pigment having a specific average volumetric particle diameter is discharged using a head of the same type incorporating a piezoelectric element having different surface roughness, the discharge velocity differs depending on the difference in surface roughness.

In other words, when the average volumetric particle diameter of pigment is out of the above range, the average discharge velocity of ink droplet decreases, so that delay occurs in discharge velocity of ink droplet between different nozzles and deterioration in image quality such as lines or uneven coloring is caused.

To the contrary, when the volumetric average particle diameter of pigment falls within the range of the present invention, the influence of pigment exerted on sedimentation and cover-up characteristic is reduced, and discharge velocity of ink droplet is stabilized, and occurrence of lines or uneven coloring can be suppressed.

It was also revealed that when a multi-nozzle type liquid droplet discharge head in which an apart of wall surface of liquid chamber is formed of a piezoelectric element is used, the discharge velocity of ink has correlation with average surface roughness Ra of piezoelectric element and average volumetric particle diameter D of pigment. That is, by making the surface roughness Ra of the piezoelectric element and the average volumetric particle diameter D of the pigment satisfy the above formula (2), it is possible to stably discharge ink droplets at a discharge velocity of 9 m/s or larger.

This may be explained from the following facts. That is, taking the surface roughness of the piezoelectric element as a hemispherical particle on a planner plate, force F between the electric double layer of the hemispherical particle and pigment particle is represented by the following formula (3). This formula is described in "Applied interface, Colloid Chemistry Handbook (NTS Inc.)", first printing, issued in January 2006, pp. 558.

$$F=2\pi\times V\times Ra\times(D/2)/(Ra+D/2) \quad (3)$$

(wherein, Ra is arithmetic average surface roughness of piezoelectric element, D is average volumetric particle diameter of pigment, and V is interaction energy per unit area of electric double layer).

The term V in the above formula (3) is considered to be substantially constant in the range where particle diameter does not change significantly. It can be understood that magnitude of force F across the electric double layer follows the term of $Ra\times(D/2)/(Ra+D/2)$. And when the term falls within the range of the present invention, that is, the above formula (2) is satisfied, it is possible to stably discharge ink droplet at the discharge velocity of larger than the lower limit value (substantially 9 m/s or larger) without influenced by the sheet conveying velocity.

Since the pigment ink and the piezoelectric inkjet recording head used in the present embodiment are the same as those of the first, detailed explanation will not be repeated. Also the piezoelectric element in the present embodiment is produced in a similar manner as the first embodiment. Adjustment of arithmetic surface roughness in the surface of the piezoelectric element which is to become a part of wall surface of the pressure chamber may be achieved, for example, but not limited to, by mechanically polishing or etching the surface of the piezoelectric element 10 which is to become a part of wall surface of the pressure chamber.

The second embodiment is otherwise similar to the first embodiment, and the description thereof is therefore omitted.

Examples and Comparative Examples of the present invention will now be described. It is understood, however, that the examples are for the purpose of illustration and the invention is not to be regarded as limited to any of the specific materials or condition therein.

EXAMPLES

Example 1

(Fabrication of Piezoelectric Inkjet Head)

A piezoelectric inkjet head having the structure shown in FIG. 1 and FIGS. 2(*a*), (*b*), in which dot formation parts having the following structures are arranged on the substrate 1 was used.

pressure chamber 2: area 0.2 $mm^2$, width 2200 μm, depth 100 μm nozzle flow channel 4: diameter 200 μm, length 800 μm supply port 5: diameter 30 μm, length 40 μm nozzle 3: length 30 μm

1 opening 30: circle of 10 μm diameter

Each line includes 166 dot formation parts each consisting of the above parts, and in total (four lines), 664 dot formation parts are arranged on the substrate 1.

The pitch between the dot formation parts in the same line is 150 dpi, and the total of 600 dpi is established by shifting the neighboring lines by ½ pitch.

Next, a preparation example of pigment ink used in the present invention will be explained.

(Pigment Dispersion)

A pigment of commercially available copper phthalocyanine C.I. Pigment Blue 15:3 (available from Clariant in Japan) was put into concentrated sulfuric acid (98%) and the temperature was raised to 160±5° C. and stirred for 90 minutes. After cooled to 15° C., the reaction solution was dropped into cold water under stirring so that the internal temperature does not exceed 5° C. After aging for 1 hour at a temperature of lower than 5° C., filtration and washing were repeated to obtain a hydrophilic pigment paste (dispersion). Then, after adding 0.26% by weight of triethanolamine to the hydrophilic pigment solution, the mixture was dispersed by circulation at a circumferential velocity of 10 m/s, at a liquid temperature of 8° C. for 180 minutes by using a disc-type bead mill (available from Shinmaru Enterprises Corporation, type KDL, media: using 0.3 mmϕ zirconia ball) to obtain a pigment dispersion (1) having an average volumetric particle diameter of 69 nm.

As to the average volumetric particle diameter of pigment, pigment having desired particle diameter can be obtained by varying the dispersing time, 180 minutes. By varying the dispersing time of pigment dispersion (1) to 150, 120, 100, 80 minutes, respectively, pigment dispersions (2) to (5) were obtained.

Using the pigment dispersions (1) to (5) obtained in the above methods, ink solutions were prepared according to the formulation shown in Table 1, and after stirring for 30 minutes, the solutions were filtered through a membrane filter having a pore diameter of 5 μm, and degassed in vacuum, to give inks (1) to (5). In Table 1, the unit in the pigment ink composition is part by weight.

TABLE 1

| | Ink (1) | Ink (2) | Ink (3) | Ink (4) | Ink (5) |
|---|---|---|---|---|---|
| Pigment dispersion (1) | 33.3 | | | | |
| Pigment dispersion (2) | | 33.3 | | | |
| Pigment dispersion (3) | | | 33.3 | | |
| Pigment dispersion (4) | | | | 33.3 | |
| Pigment dispersion (5) | | | | | 33.3 |
| Glycerol | 10 | 10 | 10 | 10 | 10 |
| 2-pyrrolidone | 6 | 6 | 6 | 6 | 6 |
| Surfynol 465* | 0.5 | 0.5 | 0.5 | 0.5 | 0.5 |
| Distilled water | 52.2 | 52.2 | 52.2 | 52.2 | 52.2 |
| Average volumetric particle diameter (nm) | 69 | 78 | 132 | 200 | 215 |

*Available from Air Products Japan Inc.

(Evaluation Method)

Using the piezoelectric inkjet recording system mounting the piezoelectric inkjet head and ink obtained in the above, charging ratio of ink was examined. Evaluation was made in the following manner. In brief, to a piezoelectric inkjet head incorporating a piezoelectric element having either one of the average surface inclinations Δa shown in Table 2, either one of the inks (1) to (5) was charged, and a nozzle check pattern was printed at a driving voltage of 17V and at a driving frequency of 15 kHz. The number of non-discharge nozzle on the printed check pattern was counted, and the ink charging ratio was determined according to the following formula (4). Results are shown in Table 2.

$$\text{Ink charging ratio}(\%)=[\text{discharge nozzle number}/\text{total nozzle number}]\times 100 \quad (4)$$

Average surface inclination of piezoelectric element, volumetric average particle diameter of pigment, and image density in the present example were measured in the following manner.

(Measurement of Average Volumetric Particle Diameter)

Average volumetric particle diameter of pigment was determined by measuring average volumetric particle diameter of each hydrophilic pigment dispersion using an electrophoresis light scattering photometer ELS-8000 available from OTSUKA ELECTRONICS CO., LTD.

(Measurement of Average Surface Inclination)

Average surface inclination Δa of piezoelectric element surface was measured using an optical interferotype surface roughness measuring device (available from Veeco Instruments, Wyko NT1100), and arithmetic average surface inclination (mrad) was determined therefrom. Standard deviation σ of Δa of the piezoelectric element used in the present invention was derived from average surface inclination at five specified points on the piezoelectric element surface. The results were $0.5 \leqq \sigma \leqq 0$ for the piezoelectric element having Δa of 90 to 250 mrad and $50 \leqq \sigma \leqq 100$ for the piezoelectric element having Δa of 1000 to 1200 mrad.

(Measurement of Image Density (O.D.))

Measurement of image density was conducted for a solid image by a GretagMacbeth densitometer. The acceptable line was image density of 1.00 or higher.

TABLE 2

Ink charging ratio (%) and Image density

| | | Arithmetic average surface inclination Δ a(mrad) | | | | | Image density |
|---|---|---|---|---|---|---|---|
| | | 92 | 98 | 243 | 1016 | 1131 | (Δ a = 92) |
| Average volumetric particle diameter (nm) | 69 | 100 | 100 | 100 | 100 | 80 | 0.94 |
| | 78 | 100 | 100 | 100 | 100 | 76 | 0.95 |
| | 132 | 100 | 100 | 100 | 100 | 64 | 1.10 |
| | 200 | 100 | 100 | 100 | 100 | 68 | 1.10 |
| | 215 | 100 | 95 | 88 | 80 | 63 | 1.10 |

(Evaluation Result)

Figure 5:
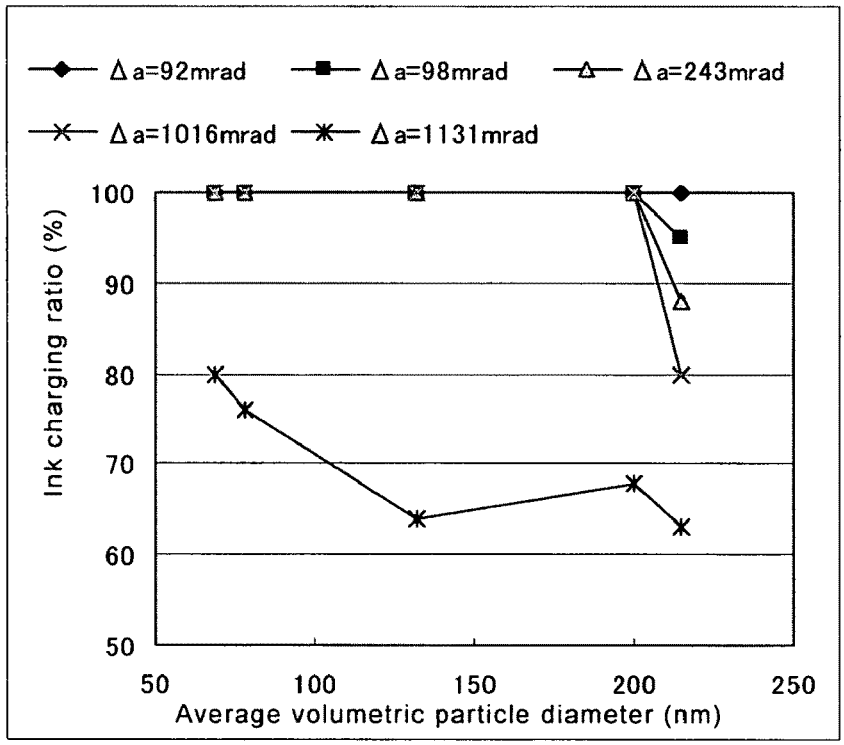
FIG. 5 is a graph showing the relationship between average volumetric particle diameter of pigment and charging ratio of ink.
Figure 6:
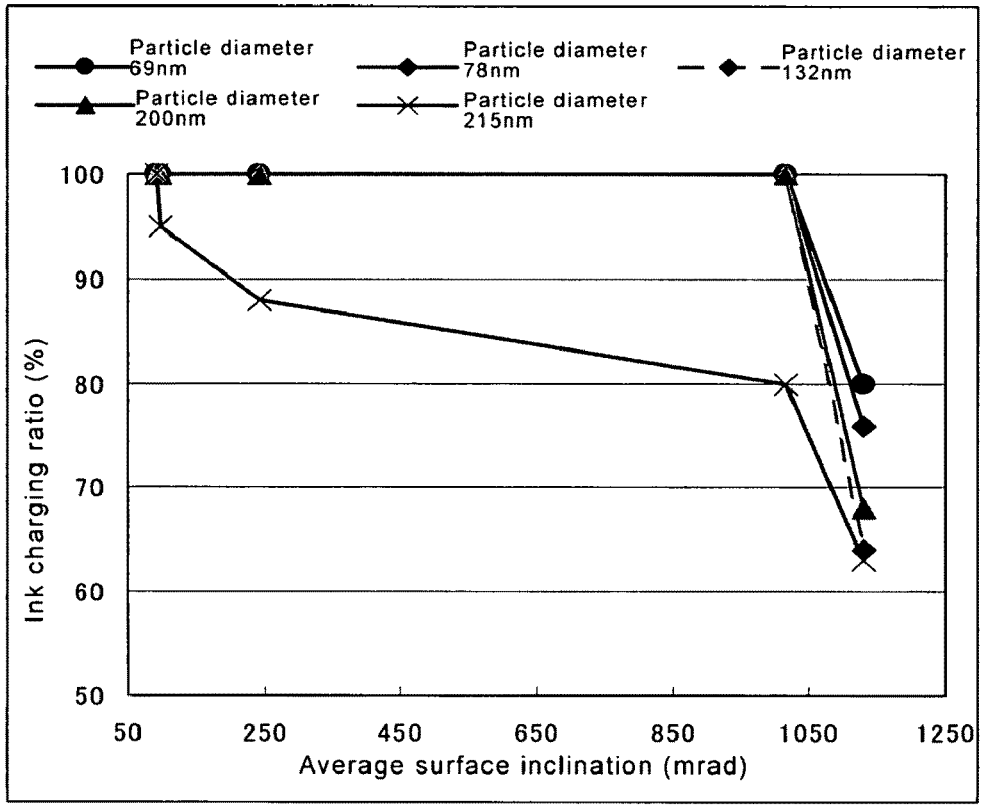
FIG. 6 is a graph showing the relationship between average surface inclination of piezoelectric element and charging ratio of ink.
Figure 7A:
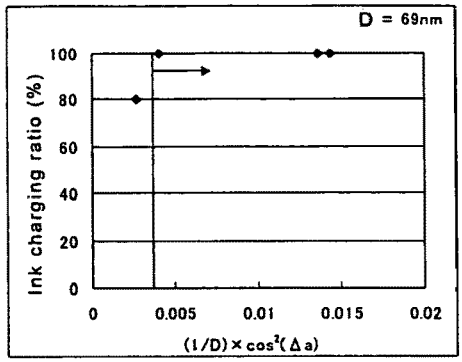
FIGS. 7A to 7E are graphs showing the relationship between $(1/D)\times\cos^2(\Delta a)$ and charging ratio of ink ($\Delta a$ is rad)
Figure 7B:
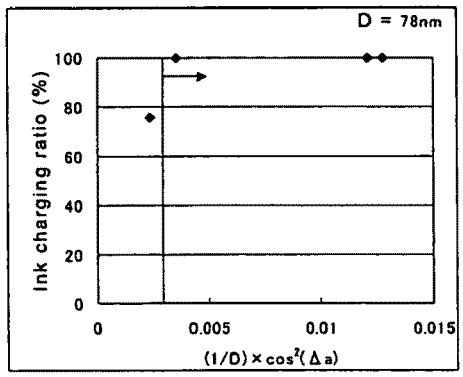
Figure 7C:
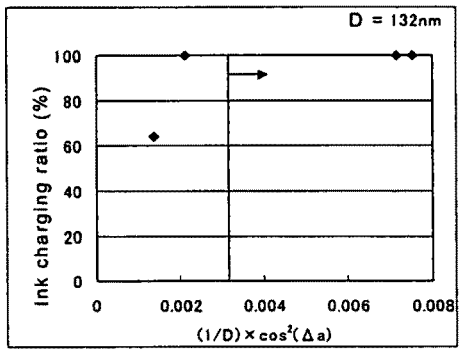
Figure 7D:
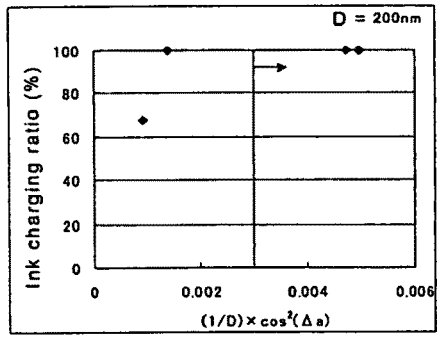
Figure 7E:
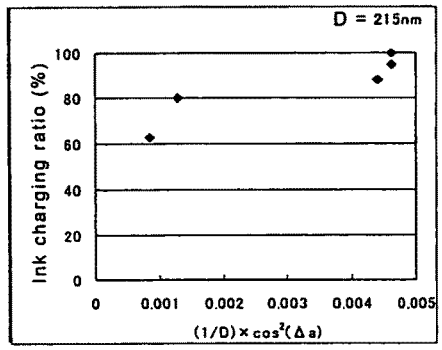

The obtained result is shown in Table 2, and graphs from Table 2 are shown in FIGS. 5 to 7. Image densities shown in Table 2 are measurements when the piezoelectric element having average surface inclination Δa of surface of 92 mrad is used.

As shown in Table 2, when both of average surface inclination Δa of piezoelectric element and average volumetric particle diameter D of pigment were within the ranges of the present invention, any ink charging ratios exhibited 100%. Contrarily, when Δa or D was out of the range of the present invention, the charging ratio of ink was 63 to 100%, and many non-discharge nozzles occurred.

FIG. 5 is a graph showing the relationship between charging ratio of ink and average volumetric particle diameter of pigment for each average surface inclination Δa. This graph shows that the ink charging ratio tends to decrease as the average volumetric particle diameter of pigment contained in ink increases.

FIG. 6 is a graph showing the relationship between charging ratio of ink and average surface inclination Δa for each average volumetric particle diameter of pigment. This graph shows that the charging ratio of ink tends to decrease as the average surface inclination Δa increases.

FIGS. 7(A to 7C are plots of ink charging ratio with respect to $(1/D)\times\cos^2(\Delta a)$ of formula (1). Δa is converted into rad. On the right side of the arrow in graphs of FIGS. 7A to 7D, the range of Δa is about 100 to about 1000 mrad, and particle diameters of pigment of 200 nm or less showed excellent charging ratio of ink. However, the evaluation result of image density shown in Table 2 reveals that cover-up characteristic on the recording sheet decreases and sufficient image density is not obtained at a particle diameter of less than 80 nm. Contrarily, when the particle diameter of pigment is 214 nm as shown in FIG. 7E, it was demonstrated that ink charging ratio is desired only in the case where a piezoelectric element having average surface inclination of piezoelectric element of 92 mrad is used. However, when the particle diameter of pigment exceeds 200 nm, clogging in a nozzle or sedimentation of pigment particles may occur. From these facts, the range of particle diameter where influence exerted on sedimentation of pigment or cover-up characteristic is small is from 80 to 200 nm.

According to the present invention, as one measure for improving ink charging ratio, a particle diameter within the range that will little cause the trouble of reducing the cover-up property of pigment for the material to be recorded is used, and both of the particle diameter D (nm) contained in the ink and the average surface inclination Δa (mrad) of piezoelectric element fall within the ranges of the present invention. Preferably, when the value of $(1/D)\times\cos^2(\Delta a/1000)$ is 0.003 or larger, the ink charging ratio improves, and jet disability due to non-discharge nozzles and dot missing can be significantly reduced.

Example II (Fabrication of Piezoelectric Inkjet Head)

A piezoelectric inkjet head having the same structure with that in Example I was used. Pigment inks (1) to (5) were obtained in the same manner as described in Example I.

TABLE 3

| | Ink (1) | Ink (2) | Ink (3) | Ink (4) | Ink (5) |
|---|---|---|---|---|---|
| Pigment dispersion (1) | 33.3 | | | | |
| Pigment dispersion (2) | | 33.3 | | | |
| Pigment dispersion (3) | | | 33.3 | | |
| Pigment dispersion (4) | | | | 33.3 | |
| Pigment dispersion (5) | | | | | 33.3 |
| Glycerol | 10 | 10 | 10 | 10 | 10 |
| 2-pyrrolidone | 6 | 6 | 6 | 6 | 6 |
| Surfynol 465* | 0.5 | 0.5 | 0.5 | 0.5 | 0.5 |
| Distilled water | 52.2 | 52.2 | 52.2 | 52.2 | 52.2 |
| Average volumetric particle diameter (nm) | 69 | 78 | 132 | 200 | 215 |
| Image density (O.D.) | 0.94 | 0.95 | 1.11 | 1.1 | 1.1 |

*Available from Air Products Japan Inc.

(Evaluation Method)

Using the piezoelectric inkjet recording system mounting the piezoelectric inkjet head and ink obtained in the above, image density and discharge velocity of ink droplet were examined. Evaluation was made in the following manner. That is, to a piezoelectric inkjet head incorporating a piezoelectric element having either one of the average surface roughness Ra shown in Table 4, an ink shown in Table 3 was charged, and the ink was discharged via a nozzle under the condition of driving voltage of 17V and a driving frequency of 15 kHz. Image density of the obtained image was measured, and average velocity (m/s) at the time of ink discharge was calculated to make evaluation. Results are shown in Tables 3 to 5.

Image density, volumetric average particle diameter of pigment, ink discharge velocity and average surface roughness of piezoelectric element in the present example were measured in the following manner.

(Image Density)

As to image density, a solid image of 2 cm×2 cm printed with each ink on plain paper (CC-99) was left still for 24 hours, and measurements at five points using an optical densitometer X-Rite MODEL 404 (available from X-Rite) were averaged.

(Measurement of Average Volumetric Particle Diameter)

Average volumetric particle diameter of pigment was determined by measuring average volumetric particle diameter of each hydrophilic pigment dispersion using an electrophoresis light scattering photometer ELS-8000 available from OTSUKA ELECTRONICS CO., LTD.

(Measurement of Discharge Velocity)

Ink droplet is discharged from a printer head in the vertically downward direction with regard to the nozzle face of the piezoelectric inkjet, and an ink droplet passing between two points, a measurement start point at 1.4 mm from the nozzle face in the vertically downward direction, and a measurement end point at 1.5 mm, was imaged by a high-speed camera [HyperVision HPV-1 available from Shimadzu Corporation], and average velocity was determined.

(Measurement of Average Surface Roughness)

As to arithmetic average surface roughness Ra of piezoelectric element surface, the bottom end face of the piezoelectric element was examined using an optical interferotype surface roughness measuring device (available from Veeco Instruments, Wyko NT1100), and arithmetic average surface roughness (μm) was determined therefrom.

TABLE 4

| Average volumetric particle diameter (nm) | Average surface roughness Ra (μm) | Formula (1) | Average discharging velocity (m/s) |
|---|---|---|---|
| 69 | 0.04 | 18.5 | 9.38 |
| | 0.05 | 20.4 | 9.37 |
| | 0.14 | 27.7 | 9.28 |
| | 1.34 | 33.6 | 9.18 |
| | 2.04 | 33.9 | 9.17 |
| | 2.27 | 34 | 9.09 |
| 78 | 0.04 | 19.7 | 9.38 |
| | 0.05 | 21.9 | 9.37 |
| | 0.14 | 30.5 | 9.27 |
| | 1.34 | 37.9 | 9.18 |
| | 2.04 | 38.3 | 9.13 |
| | 2.27 | 38.3 | 9.08 |
| 132 | 0.04 | 24.9 | 9.34 |
| | 0.05 | 28.4 | 9.31 |
| | 0.14 | 44.9 | 9.22 |
| | 1.34 | 62.9 | 9.05 |
| | 2.04 | 63.9 | 8.98 |
| | 2.27 | 64.1 | 8.91 |
| 200 | 0.04 | 28.6 | 9.13 |
| | 0.05 | 33.3 | 9.09 |
| | 0.14 | 58.3 | 8.96 |
| | 1.34 | 93.1 | 8.84 |
| | 2.04 | 95.3 | 8.81 |
| | 2.27 | 95.8 | 8.79 |
| 215 | 0.04 | 29.2 | 9.11 |
| | 0.05 | 34.1 | 9.03 |
| | 0.14 | 60.8 | 8.93 |
| | 1.34 | 99.5 | 8.81 |
| | 2.04 | 102.1 | 8.79 |
| | 2.27 | 102.6 | 8.76 |

(Evaluation Result)

As shown in Table 3, when average volumetric particle diameter of pigment was 80 nm or more, sufficient image density (O.D.) of 1.0 or higher was obtained. Contrarily, when the particle diameter was less than 80 nm, cover-up characteristic on the recording sheet was deteriorated, and image density was 1.0 or less, so that sufficient image density was not obtained.

Figure 9:
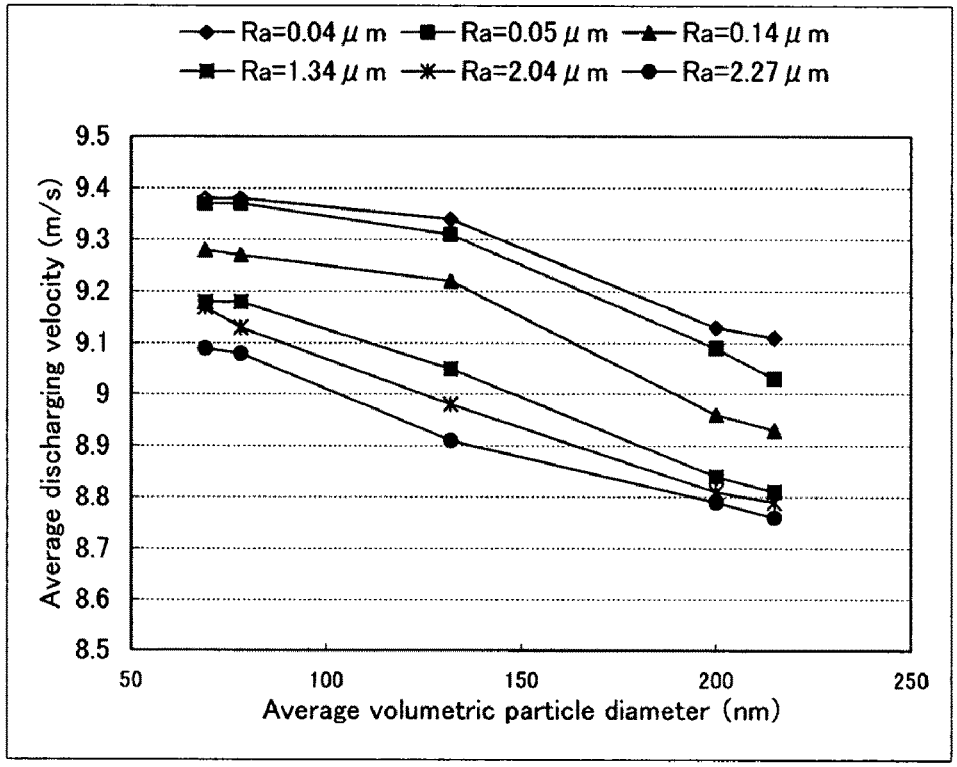
FIG. 9 is a graph showing the relationship between average volumetric particle diameter of pigment and average discharge velocity of ink.
Figure 10:
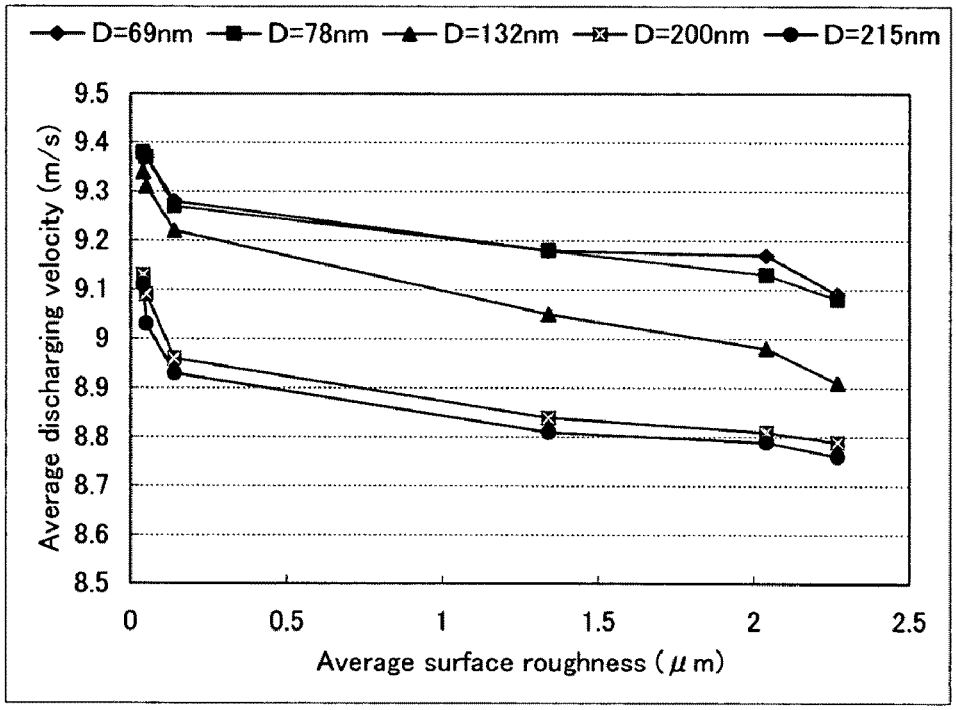
FIG. 10 is a graph showing the relationship between average surface roughness of piezoelectric element and average discharge velocity of ink.
Figure 11A:
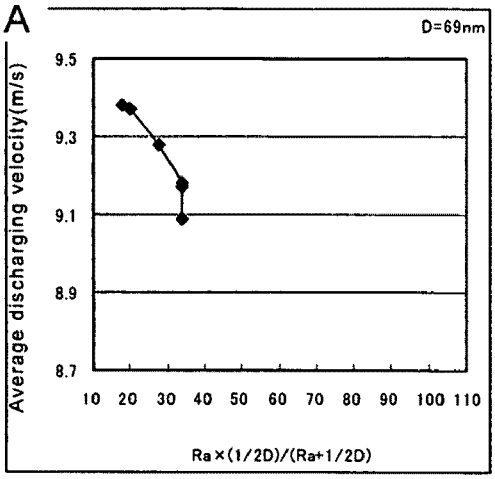
FIGS. 11A to 11E show graphs showing the relationship between $Ra\times(D/2)/(Ra+D/2)$ according to the present invention and average discharge velocity.
Figure 11D:
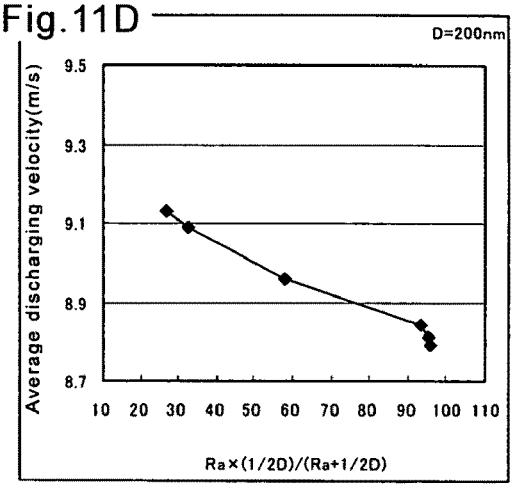
Figure 11B:
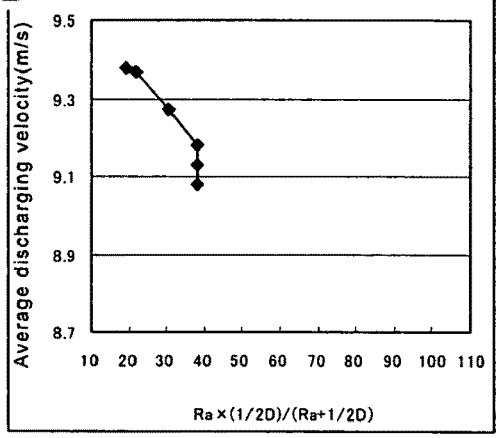
Figure 11E:
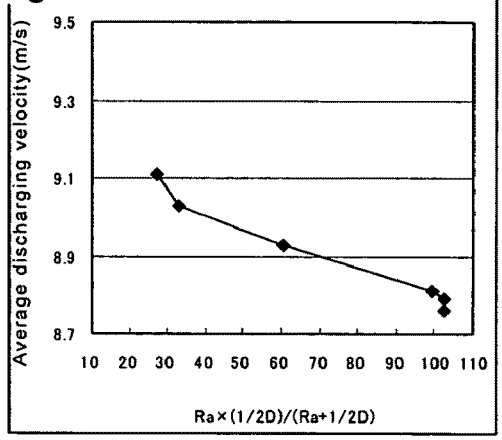
Figure 11C:
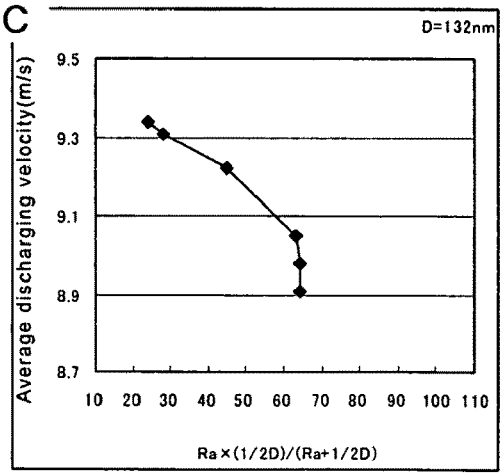

FIGS. 9 to 11 show graphs based on Tables 4.

FIG. 9 is a graph showing the relationship between discharge velocity of ink and average volumetric particle diameter of pigment for each average surface roughness Ra. This graph demonstrates that ink discharge velocity tends to decrease as the average volumetric particle diameter of pigment contained in the ink increases.

FIG. 10 is a graph showing the relationship between discharge velocity of ink and average surface roughness Ra for each average volumetric particle diameter of pigment. This graph demonstrates that ink discharge velocity tends to decrease as the average surface roughness Ra increases.

FIGS. 11A to 11E are plots of discharge velocity of ink, with respect to $Ra\times(D/2)/(Ra+D/2)$ of formula (2). From FIG. 11, it can be seen that when particle diameter D of pigment and the value of the above formula (1) fall within the ranges of the present invention, average discharge velocity of ink is 9 m/s or larger. However, when particle diameter D of pigment exceeds 200 nm, it is difficult to keep the velocity of 9 m/s or larger. In conclusion, the range of particle diameter in which influence exerted on sedimentation of pigment or cover-up characteristic is small, and desired discharge velocity are obtained is from 80 to 200 nm.

From these facts, it was demonstrated that as a measure for making ink land at stable velocity when the method that discharges recording ink having average volumetric particle diameter D (nm) of $80 \leqq D \leqq 200$ is used, and the formula (2) is satisfied, it is possible to keep the discharge velocity of ink droplet at a velocity of 9 m/s or larger, so that an image of high quality can be formed with little deviation at the time of landing and uneven coloring of ink droplet under the influence of sheet conveying velocity.

What is claimed is:

1. An inkjet recording system that discharges pigment ink from a liquid droplet discharge head in which a part of wall surface of a pressure chamber is formed of a piezoelectric element, wherein arithmetic average surface inclination Δa (mrad) of the piezoelectric element forming a part of wall surface of the pressure chamber satisfies $\Delta a \leqq 1050$, and average volumetric particle diameter D (nm) of pigment contained in the ink satisfies $80 \leqq D \leqq 200$.

2. The inkjet recording system according to claim 1, wherein arithmetic average inclination Δa (mrad) of surface of the piezoelectric element forming a part of wall surface of the pressure chamber, and average volumetric particle diameter D (nm) of the pigment satisfy the following formula (1):

$$(1/D)\times\cos^2(\Delta a/1000)>0.003 \quad (1).$$

3. The inkjet recording system according to claim 1, wherein the discharge head is a multi-nozzle type liquid droplet discharge head.

4. An inkjet recording system that discharges pigment ink from a liquid droplet discharge head in which a part of wall surface of a pressure chamber is formed of a piezoelectric element, wherein average volumetric particle diameter D (nm) of pigment contained in the ink satisfies $80 \leqq D \leqq 200$, and the following formula (2) is satisfied:

$$20<Ra\times(D/2)/(Ra+D/2)<55 \quad (2)$$

wherein, Ra is arithmetic surface roughness (nm) of surface of the piezoelectric element forming a part of wall surface of the pressure chamber, and D is average volumetric particle diameter (nm).

5. The inkjet recording system according to claim 4, wherein the discharge head is a multi-nozzle type liquid droplet discharge head.

6. A liquid droplet discharge head for inkjet recording, which is suitable for discharging pigment ink containing pigment of which average volumetric particle diameter D (nm) satisfies $80 \leqq D \leqq 200$, and in which a part of wall surface of a pressure chamber is formed of a piezoelectric element, wherein arithmetic average surface inclination Δa (mrad) of the piezoelectric element forming a part of wall surface of the pressure chamber satisfies $\Delta a \leqq 1050$.

7. The liquid droplet discharge head according to claim 6, wherein arithmetic average inclination Δa (mrad) of surface of the piezoelectric element, and average volumetric particle diameter D (nm) of the pigment satisfy the following formula (1):

$$(1/D)\times\cos^2(\Delta a/1000)>0.003 \quad (1).$$

8. A pigment ink for inkjet recording, discharged from liquid droplet discharge head in which a part of wall surface of a pressure chamber is formed of a piezoelectric element, the surface of which arithmetic average surface inclination Δa (mrad) satisfies $\Delta a \leqq 1050$, wherein the pigment ink comprises a pigment of which average volumetric particle diameter D (nm) satisfies $80 \leqq D \leqq 200$, and an aqueous medium containing pigment.

9. The pigment ink according to claim 8, wherein the aqueous medium is water or a mixture of water and aqueous organic solvent.

10. A liquid droplet discharge head for inkjet recording, which is suitable for discharging pigment ink, and in which a part of wall surface of a pressure chamber is formed of a piezoelectric element, wherein arithmetic surface roughness Ra (nm) of the surface of the piezoelectric element forming a part of wall surface of the pressure chamber satisfies the following formula (2):

$$20<Ra\times(D/2)/(Ra+D/2)<55 \quad (2)$$

wherein, D is average volumetric particle diameter (nm), $80 \leqq D \leqq 200$.

11. A pigment ink for inkjet recording, discharged from liquid droplet discharge head in which a part of wall surface of a pressure chamber is formed of a piezoelectric element, comprising a pigment of which average volumetric particle diameter D (nm) satisfies $80 \leqq D \leqq 200$, and an aqueous medium containing pigment, and average volumetric particle diameter D (nm) of the pigment and arithmetic surface roughness Ra (nm) of surface of the piezoelectric element forming a part of wall surface of the pressure chamber satisfy the following formula (2):

$$20<Ra\times(D/2)/(Ra+D/2)<55 \quad (2).$$

12. The pigment ink according to claim 11, wherein the aqueous medium is water or a mixture of water and aqueous organic solvent.

* * * * *